United States Patent [19]

Violante

[11] 4,282,613

[45] Aug. 11, 1981

[54] CONVERTIBLE INVALID BED

[76] Inventor: Anthony E. Violante, 5058 Chatsworth Ave., Detroit, Mich. 48224

[21] Appl. No.: 108,520

[22] Filed: Dec. 31, 1979

[51] Int. Cl.[3] ..... A616 7/02

[52] U.S. Cl. ..... 5/90; 5/66

[58] Field of Search ..... 5/66–68, 5/72, 90

[56] References Cited

U.S. PATENT DOCUMENTS

| | | | |
|---|---|---|---|
| 12,940 | 5/1855 | Arnold | 5/90 |
| 470,251 | 3/1892 | Morrison | 5/90 |
| 1,186,059 | 6/1916 | Yarrington | 5/90 |
| 1,248,113 | 11/1917 | Henning | 5/68 |
| 1,617,108 | 2/1927 | Gursky | 5/67 |

FOREIGN PATENT DOCUMENTS

| | | | |
|---|---|---|---|
| 1458835 | 11/1966 | France | 5/90 |

*Primary Examiner*—Casmir A. Nunberg

*Attorney, Agent, or Firm*—Barnes, Kisselle, Raisch & Choate

[57] ABSTRACT

An invalid bed comprising three pivotally connected mattress supporting sections designed to permit the bed to be converted into a seat for the invalid. The center or seat section of the bed is provided with an opening for enabling use of the bed as a commode when it is converted into a seat.

7 Claims, 3 Drawing Figures

CONVERTIBLE INVALID BED

This invention relates to an invalid bed and more particularly to a bed of the type provided with a commode opening in the mattress and mattress support to facilitate bowel movements by the invalid when the bed is converted into a commode seat.

There have been proposed heretofore convertible invalid beds provided with openings arranged to permit the patient to eliminate body waste. For the most part such beds have been of rather complicated and costly construction. Likewise, the design of such beds has been such that they are difficult to convert into a commode seat and necessitate considerable discomfort to and movement of the invalid when converted to a commode seat.

The object of the present invention is to provide a bed of the type described which is of economical construction and which is easily and quickly converted to and from a commode seat.

A further object of the present invention is to provide a bed of the type described which permits a minimum movement and discomfort to the patient when converted to and from a commode seat and which is designed to comfortably support an invalid seated thereon.

The above objects are achieved by providing the bed with a head section, a seat section and a foot section. The head section and the foot section are pivotally connected to the opposite ends of the seat section so that the head section can be pivoted to a generally upright position and the foot section can be pivoted to a vertically downwardly extending position to form a seat for the invalid whose back is comfortably supported in an upright position by the head section while the invalid's legs comfortably overhang the front end of the seat section. The seat section has an opening therein located generally to overlie the buttocks of an invalid lying in the bed so that the invalid is merely erected from a lying position to an upright seated position when the bed is converted to a commode seat. The head and foot sections are supported at their free ends by pivoted legs which are adapted to be folded to a collapsed position underlying their respective sections when the bed is converted into a seat. The legs for the foot section are preferably designed so that they can be shortened and, thereby, nested against the underside of the foot section when it is pivoted downwardly to convert the bed into a seat.

Other objects, features and advantages of the present invention will become apparent from the following description and accompanying drawing, in which.

Figures 1, 2, 3:
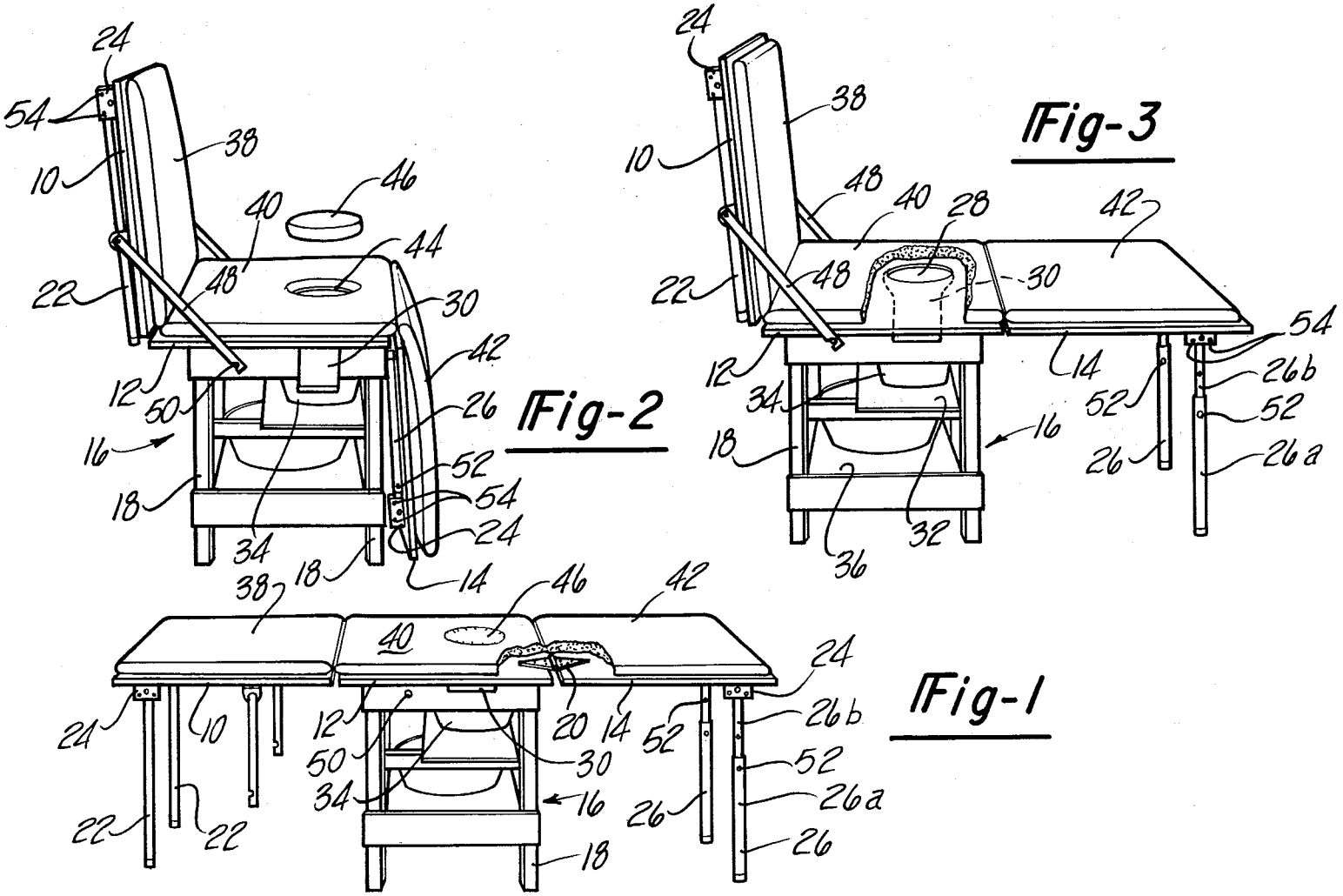
FIG. 1 is a perspective view of the bed of this invention when arranged to support an invalid in a lying position.
FIG. 2 is a perspective view of the bed converted into a commode seat.
FIG. 3 is a perspective view of the bed when arranged to support an invalid in a semi-reclining position.

Referring to the drawing, the bed of the present invention comprises three mattress supporting sections; namely, a head section 10, a seat section 12, and a foot section 14. Although each of these sections is illustrated in the drawing as a flat panel, it will be understood that they may be constructed in any suitable form, such as individual spring sections, slatted frames, etc. The seat section 12 is supported on a rigid frame 16 having four permanently attached legs 18. The rear end of foot section 14 is pivotally connected to the front end of seat section 12 by any suitable means (such as hinges 20). The front end of the head section 10 is similarly pivotally connected to the rear end of seat section 12. A pair of legs 22 are pivotally connected at their upper ends to brackets 24 secured to the underside of head section 10. Likewise, a pair of legs 26 are pivotally connected to similar brackets 24 secured to the underside of foot section 14 adjacent the front end thereof. In the position shown in FIG. 1 the legs 22,26 support the head and foot sections 12,14, respectively, in a position horizontally aligned with the seat section 12.

The seat section 12 is provided with an opening 28 which is centered in a direction transversely of seat section 12 but which in a longitudinal direction is located closer to the front edge of section 12 than its rear edge. A closure member 30 is slideably supported on the underside of section 12 so as to be transversely shiftable from a position closing the opening (FIG. 3) to a position clear of the opening (FIG. 2). Frame 16 is provided with a shelf 32 for supporting a waste receptacle 34 directly below opening 28. If desired, frame 16 may be formed with an additional bottom shelf 36 on which other items may be stored.

The bed is provided with a mattress comprising three hingedly connected sections 38,40,42. Each of these mattress sections corresponds generally in size and shape with the underlying mattress supporting sections 10,12,14, respectively. The center mattress section 40 has an opening 44 therein which is vertically aligned with the opening 28 in the seat section 12. Mattress opening 44 is removably closed by a cushion 46 which conforms in size with the opening 44 and is supported by closure member 30 when the latter is in the closed position.

The pivotal connections between the mattress supporting sections of the bed enable these sections to be easily and readily pivoted as shown in FIGS. 2 and 3 so as to form a commode seat or to form a bed with an upwardly inclined backrest. To form a commode seat the head section 10 is pivoted to a generally upright position as shown in FIG. 2 and retained in this position by means of a pair of swinging links 48 on the head section 10 that are adapted to engage with abutments 50 at each side of frame 16. When the head section 10 is erected to the upright position the legs 22 may be pivoted on brackets 24 to a position underlying and nested against the underside of head section 10. Foot section 14 is adapted to be pivoted from the horizontal position shown in FIG. 1 to the downwardly extending position shown in FIG. 2 where it is disposed in a generally vertical plane directly adjacent the front side of frame 16. When the foot section 14 is pivoted downwardly, the legs 26 are adapted to be pivoted upwardly on brackets 24 so that they underlie and are nested against the underside of foot section 14. For this reason the legs 26 are preferably constructed as two tubular members which are telescopically engaged with one another. The tubular members are designated **26*a* and 26*b*. Suitable means 52 are provided on these tubular members for retaining the legs in an extended position such as shown in FIG. 1 or in a foreshortened position such as shown in FIG. 2 to enable the legs to be folded to the collapsed position shown in FIG. 2 when the foot section 14 is pivoted downwardly. Any suitable means may be provided for retaining the legs 22,26 in either the upright position or in the collapsed position. In the embodiment illustrated these means comprise a pair of embossments 56 on each bracket 24** which is adapted to engage with the leg in either the upright or the collapsed position.

One of the features of the present invention resides in the dimensional relationship between the mattress supporting sections 10,12,14. The combined length dimension of these sections must obviously correspond generally with the length of a conventional bed. However, in view of the fact that it is most desirable to convert the unit from a bed to a commode chair with the least disturbance to the invalid occupying the same and, at the same time, provide a comfortable seat for the invalid when the unit is arranged in the manner shown in FIG. 2, I have determined that the head and foot sections 10 and 14, respectively, should be about the same length and that the seat section 12 should be substantially shorter than sections 10,14. When these sections are so proportioned and the unit is erected to the position shown in FIG. 2 the invalid can remain in a comfortably seated position thereon with his back supported by the mattress section 38 on the upright head section 10 while his legs are vertically overhanging the front edge of the seat section 12. The opening 28 in seat section 12 and the opening 44 in mattress section 40 are spaced closer to the front edge of section 12 than the rear edge thereof because in a seated position the invalid is displaced slightly forwardly of the center of seat section 12 by the thickness of the mattress sections 38,42. Thus, when an invalid is lying in the bed the cushion 46 generally underlies the invalid's buttocks. If it is desired to convert the bed into a seat or a commode, it is only necessary to pivot the head section upwardly and the foot section downwardly to the positions shown in FIG. 2. It will be appreciated that this does not require any substantial movement or displacement of the invalid. The invalid is merely erected from a lying position to a sitting position. If the invalid desires to have a bowel movement he is merely rolled over slightly while lying on the bed so as to enable removal of the cushion 46. The closure member is then pulled out transversely of the foot section 12 and, thus, with a minimum of discomfort and movement, the invalid is enabled to have a bowel movement.

I claim:

1. An invalid bed adapted to be converted into an upright commode seat comprising, three mattress supporting sections which include a rear head section, an intermediate seat section and a front foot section; said head section being connected at its front end to the rear end of the seat section for pivotal movement from a horizontal position to a position extending generally vertically upwardly from the rear end of the seat section, said foot section being connected at its rear end to the front end of the seat section for pivotal movement from a horizontal position to a position extending downwardly from the front end of the seat section in a substantially vertical plane, a rigid frame for said seat section having legs fixed to the front and rear ends thereof for supporting the seat section in a stable horizontal position at a predetermined height above the floor surface, a first pair of laterally spaced support legs pivotally connected at their upper ends adjacent the rear end of the head section, said last-mentioned legs when in upright position supporting the head section in horizontal alignment with the seat section and being pivotable from said upright position to a collapsed position underlying and nested against the underside of the head section when the head section is pivoted to said vertically upwardly extending position, a second pair of supporting legs pivotally connected at their upper ends adjacent the front end of the foot section, said second pair of legs when in an upright position supporting the foot section in horizontal alignment with the seat section and being pivotable from said upright position to a collapsed position underlying and nested against the underside of the foot section when the foot section is pivoted to said vertically downwardly extending position, said foot section having a length no greater than the length of the legs supporting the seat section to enable pivoting said foot section to said vertically downwardly extending position, said head and foot sections being of generally the same length and said seat section being of shorter length so that, when the head section is pivoted to said upwardly extending position and said foot section to said downwardly extending position, the head section forms a backrest for an invalid seated in an upright position on said seat section with his legs overhanging the front end of the seat section, said seat section having a commode opening therein disposed to generally underlie the buttocks of an invalid lying in the bed and said frame having means for supporting a receptacle directly below said opening, a closure member for said opening disposed on the underside of said seat section and slideable transversely thereof to open and close said opening, the pivot axis of said second pair of legs extending transversely of said foot section so that, when the foot section is pivoted to said downwardly extending position, the last-mentioned legs extend vertically upwardly from the lower front end of the foot section and including means for foreshortening the length of said second pair of legs to enable them to be pivoted to said collapsed position when the foot section is pivoted to said vertically downwardly extending position.

2. An invalid bed as called for in claim 1 including three hingedly connected mattress pads overlying each of said mattress supporting sections, the mattress pad for the seat section having an opening therein registering with the opening in the seat section and a mattress cushion removably disposed in said opening in the mattress section and supported by said closure member when the closure member is in the closed position.

3. An invalid bed as called for in claim 2 wherein the opening in the seat section is located substantially closer to the front end of the seat section than the rear end thereof.

4. An invalid bed as called for in claim 2 including means for retaining the second pair of legs in their collapsed position underlying and nested against the underside of the foot section.

5. An invalid bed as called for in claim 1 wherein each leg of said second pair comprises a pair of longitudinally extendable leg members.

6. An invalid bed as called for in claim 5 wherein said leg members are telescopically connected.

7. An invalid bed as called for in claim 5 including means for retaining the leg members in either the extended or the foreshortened position.

* * * * *